US008009128B2

(12) United States Patent
Hanaki et al.

(10) Patent No.: US 8,009,128 B2
(45) Date of Patent: Aug. 30, 2011

(54) PASSIVE MATRIX TYPE DISPLAY DEVICE

(75) Inventors: Takashi Hanaki, Kariya (JP); Hiroyuki Kishita, Kariya (JP); Tetsuya Katoh, Anjo (JP)

(73) Assignee: DENSO CORPORATION, Kariya (JP)

( * ) Notice: Subject to any disclaimer, the term of this patent is extended or adjusted under 35 U.S.C. 154(b) by 1075 days.

(21) Appl. No.: 11/826,847

(22) Filed: Jul. 19, 2007

(65) Prior Publication Data

US 2008/0048952 A1 Feb. 28, 2008

(30) Foreign Application Priority Data

Aug. 23, 2006 (JP) ..... 2006-227124

(51) Int. Cl.
*G09G 3/30* (2006.01)

(52) U.S. Cl. ..... 345/77; 345/76; 345/82; 345/204

(58) Field of Classification Search ..... 345/77, 345/82–83, 204; 315/169.3; 313/463
See application file for complete search history.

(56) References Cited

U.S. PATENT DOCUMENTS 6,351,255 B1 * 2/2002 Ishizuka et al. ..... 345/77
2005/0206325 A1 * 9/2005 Wakou et al. ..... 315/224

FOREIGN PATENT DOCUMENTS

JP A-10-222127 8/1998
JP A-2004-228385 8/2004
JP A-2005-77656 3/2005

* cited by examiner

*Primary Examiner* — Lun-Yi Lao
*Assistant Examiner* — Jarurat Suteerawongsa
(74) *Attorney, Agent, or Firm* — Posz Law Group, PLC

(57) ABSTRACT

A passive matrix type display device includes: a display unit having a display area; first electrodes on the area for switching between a conductive state and a non-conductive state; second electrodes on the area; a driving current source for supplying a driving current to the second electrodes; light-emitting elements at an intersection between the first and second electrodes; a first circuit for controlling a part of first electrodes to the conductive state and for scanning the first electrodes; a second circuit for deciding a part of second electrodes corresponding to a part of light-emitting elements emitting a light; light-emission adjustment elements coupled with the second electrodes for branching an adjustment current from the driving current; and a light-emission adjustment controller for controlling the light from each light-emitting element by controlling the adjustment current.

28 Claims, 16 Drawing Sheets

| | NAME | CONSTITUENT MATERIAL(S) |
|---|---|---|
| 10 | GLASS SUBSTRATE | |
| 20 | ANODE | ITO |
| 30 | HOLE INJECTION LAYER | COPPER PHTHALOCYANINE OR COMPOUND 1 |
| 40 | HOLE TRANSPORT LAYER | COMPOUND 2 OR 3 |
| 50 | LIGHT EMITTING LAYER | COMPOUND 4+RUBREN |
| 60 | ELECTRON TRANSPORT LAYER | TRIS (8-QUINOLATO) ALUMINUM |
| 70 | ELECTRON INJECTION LAYER | LITHIUM FLUORIDE |
| 80 | CATHODE | Aℓ |

FIG. 4
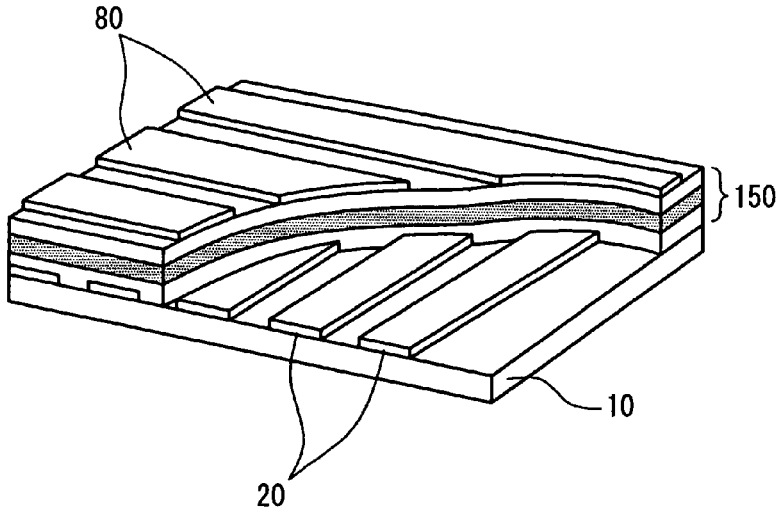
FIG. 5A
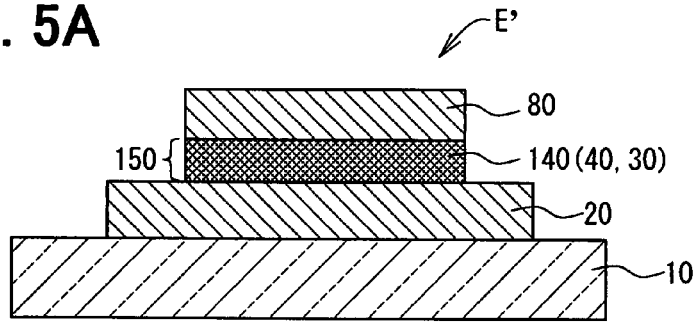
FIG. 5B
| | NAME | CONSTITUENT MATERIAL |
|---|---|---|
| 10 | GLASS SUBSTRATE | |
| 20 | ANODE | ITO |
| 140 | HOLE TRANSPORTABLE LAYER | COMPOUND 1, AND 2 OR 3 |
| 80 | CATHODE | Aℓ |

| | NAME | CONSTITUENT MATERIAL |
|---|---|---|
| 10 | GLASS SUBSTRATE | |
| 20 | ANODE | ITO |
| 140 | HOLE TRANSPORTABLE LAYER | COMPOUND 1, AND 2 OR 3 |
| 70 | ELECTRON INJECTION LAYER | LITHIUM FLUORIDE |
| 80 | CATHODE | Aℓ |

| | NAME | CONSTITUENT MATERIAL(S) |
|---|---|---|
| 10 | GLASS SUBSTRATE | |
| 20 | ANODE | ITO |
| 30 | HOLE INJECTION LAYER | COPPER PHTHALOCYANINE OR COMPOUND 1 |
| 40 | HOLE TRANSPORT LAYER | COMPOUND 2 OR 3 |
| 50' | LIGHT EMITTING LAYER | COMPOUND 4 |
| 60 | ELECTRON TRANSPORT LAYER | TRIS (8-QUINOLATO) ALUMINUM |
| 70 | ELECTRON INJECTION LAYER | LITHIUM FLUORIDE |
| 80 | CATHODE | Aℓ |

| | NAME | CONSTITUENT MATERIAL(S) |
|---|---|---|
| 10 | GLASS SUBSTRATE | |
| 20 | ANODE | ITO |
| 30 | HOLE INJECTION LAYER | COPPER PHTHALOCYANINE OR COMPOUND 1 |
| 40 | HOLE TRANSPORT LAYER | COMPOUND 2 OR 3 |
| 50" | LIGHT EMITTING LAYER | COMPOUND 2 OR 3+COMPOUND 4+RUBREN |
| 61 | ELECTRON TRANSPORT LAYER 1 | COMPOUND 4 |
| 60 | ELECTRON TRANSPORT LAYER 2 | TRIS (8-QUINOLATO) ALUMINUM |
| 70 | ELECTRON INJECTION LAYER | LITHIUM FLUORIDE |
| 80 | CATHODE | Aℓ |

| | NAME | CONSTITUENT MATERIAL(S) |
|---|---|---|
| 10 | GLASS SUBSTRATE | |
| 20 | ANODE | ITO |
| 30 | HOLE INJECTION LAYER | COPPER PHTHALOCYANINE OR COMPOUND 1 |
| 40 | HOLE TRANSPORT LAYER | COMPOUND 2 OR 3 |
| 50" | LIGHT EMITTING LAYER | COMPOUND 2 OR 3+COMPOUND 4 |
| 61 | ELECTRON TRANSPORT LAYER 1 | COMPOUND 4 |
| 60 | ELECTRON TRANSPORT LAYER 2 | TRIS (8-QUINOLATO) ALUMINUM |
| 70 | ELECTRON INJECTION LAYER | LITHIUM FLUORIDE |
| 80 | CATHODE | Aℓ |

FIG. 17
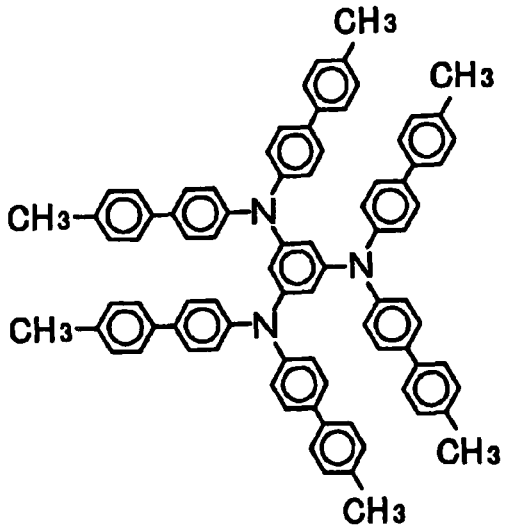
FIG. 18
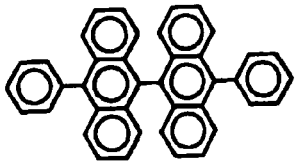
FIG. 19
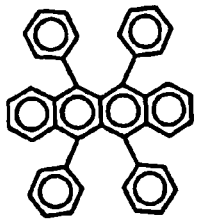
FIG. 20
| | COMPOUND No. 1 | COMPOUND No. 2 | COMPOUND No. 3 | ITO | Aℓ |
|---|---|---|---|---|---|
| Ec(ϕ) | 5.2 | 5.4 | 5.45 | 5.4 | 4 |
| Ac | 2.23 | 2.23 | 2.28 | - | - |
| ΔE | -0.2 | 0 | 0.05 | | |
| Δε | 1.77 | 1.77 | 1.72 | | |

PASSIVE MATRIX TYPE DISPLAY DEVICE

CROSS REFERENCE TO RELATED APPLICATION

This application is based on Japanese Patent Application No. 2006-227124 filed on Aug. 23, 2006, the disclosure of which is incorporated herein by reference.

FIELD OF THE INVENTION

The present invention relates to a passive matrix type display device.

BACKGROUND OF THE INVENTION

As a spontaneous light emission type display device which employs light emitting elements, there has been known one which employs LEDs or inorganic EL elements as the light emitting elements. Besides, in recent years, an organic EL display device which employs organic EL elements as the light emitting elements has been often employed for, for example, an information display panel for use in an audio equipment, or an instrument panel for an automobile. In order to display a complicated pattern, a matrix type display device in which pluralities of light emitting elements are arranged vertically and laterally is adopted. Such matrix type display devices include two sorts; a passive matrix type wherein data electrodes (column electrodes) and scanning electrodes (row electrodes) are formed in the shape of a simple lattice and wherein the elements are caused to emit lights by duty-driving these elements for only the selection periods of the scanning electrodes, and an active matrix type wherein switching transistors are disposed in one-to-one correspondence with the individual elements and wherein the corresponding elements are statically driven by the respective transistors. Since the display device of the passive matrix type is simple in structure and low in price, the products thereof have been incarnated for an image display (for example, still picture display) in the automotive instrument panel, and so forth.

The spontaneous light emission type display device as stated above is capable of direct light adjustment in accordance with the output intensity of each light emitting element itself, unlike a non-spontaneous light emission type display device such as liquid-crystal display device. However, the intensity fluctuates with the lapse of time on account of the degradation of the light emitting element, etc., and a countermeasure needs to be taken. By way of example, in the case of the organic EL display device, the degradation occurs between an organic layer constituting the organic EL element and the interface of a cathode electrode made of a metal, or the cathode electrode itself is degraded by corrosion or the like, resulting in the problem that the intensity fluctuation is liable to occur. Especially, since the passive matrix type display device is of the duty drive scheme, it needs to light up each element at a high intensity instantly, and the degradation of its element tends to proceed more than in the static drive type.

It has been attempted to cope with the degradation of the element having occurred, by the stabilization of a supply voltage, or the like. Merely by the stabilization of the supply voltage, however, it has hitherto been difficult to satisfactorily cope with the intensity fluctuation of each light emitting element. Besides, the on-vehicle display device has the problem that a battery voltage serving as the supply voltage is prone to fluctuate with a large width, depending upon a load situation or the situation of use of an alternator, or due to the degradation of a battery itself, or the like, so the voltage fluctuation is liable to exert direct influence on the drive voltage of the display device, in turn, the output intensity. In the case of, for example, the organic EL element, it has been known that the intensity changes exponentially in the voltage-intensity characteristic thereof, and that the characteristic changes greatly, depending upon temperatures. On the other hand, in the current density-intensity characteristic of the organic EL element, the intensity increases substantially in proportion to the current density. This is because the organic EL element includes in equivalent circuit-wise, a diode constituent which is a rectifying element, and an internal resistance constituent which appears in series with the diode constituent. The proportionality of the intensity to the current density is elucidated by a quantum-mechanical light emission mechanism in which current energy is converted into light energy on the basis of the light emission recombination process of carriers (electrons/holes). Besides, the nonlinear change of the current density (namely, the intensity) versus the voltage is elucidated by a non-ohmic characteristic peculiar to the diode. Further, the temperature dependency of the characteristic is elucidated by the resistance temperature dependency of the internal resistance constituent, the thermal excitation process of the carriers in the diode constituent, etc. Anyway, in such a spontaneous light emission type display device, it has been desired to dispose a light adjustment mechanism for the purpose of stabilizing the output intensities of the individual elements, or coping with an intensity alteration which conforms to a user's favorite.

In the passive matrix type display device, possible methods are broadly classified into two schemes; a scheme wherein the light emission intensity of the element is subjected to a voltage light-adjustment control, and a scheme wherein it is subjected to a current light-adjustment control. In the case of, for example, the organic EL display device, when the voltage drive control is intended, it is necessary to compensate the temperature characteristic of the intensity and to relieve the nonuniform temperature distribution of a panel. Besides, since the voltage-intensity characteristic of the element is abrupt, it is necessary to consider the setting of a subtle voltage value. On the other hand, when the current drive control is intended, the temperature compensation need not be considered. Moreover, since the current-intensity characteristic of the element is linear, the control of a current value, in turn, the intensity is easy. That is, current drive as disclosed in Patent Document 1 (JP-A-10-222127) is advantageous for the drive of the organic EL display device, and the current light-adjustment control scheme has been generally employed in case of adjusting light, as disclosed in Patent Document 2 (JP-A-2005-77656).

However, the constant-current control type driver IC of an organic EL display device commercially available has its current control range limited, and it is therefore incapable of adjusting light in a wide range. Especially, it has the difficulty of lacking in the stability of the light adjustment control of a low intensity side. Another problem is that, as a current value which is outputted becomes smaller, the intensity dispersion between output channels (sets of pixels connected in parallel by a data (column) electrode) enlarges more.

Thus, it is required for a passive matrix type display device to have a light adjustment function which can perform the light adjustment control of a low intensity side stably and inexpensively.

SUMMARY OF THE INVENTION

In view of the above-described problem, it is an object of the present disclosure to provide a passive matrix type display device.

According to an aspect of the present disclosure, a passive matrix type display device includes: a display unit having a display area, wherein the display area has first and second directions, which intersect with each other; a plurality of first electrodes disposed on the display area, wherein the plurality of first electrodes is arranged along with the second direction at predetermined first intervals, wherein each first electrode is capable of switching between a conductive state and a non-conductive state, wherein the first electrode in the conductive state is capable of passing a driving current so that the conductive state provides a light-emitting connection, and wherein the first electrode in the non-conductive state is capable of intercepting the driving current so that the non-conductive state provides a non-light-emitting connection; a plurality of second electrodes disposed on the display area, wherein the plurality of second electrodes is arranged along with the first direction at predetermined second intervals; a driving current source for controlling the driving current in a predetermined range and supplying the driving current to the plurality of second electrodes, wherein the driving current source is coupled with the plurality of second electrodes in a switchable manner between the conductive state and the non-conductive state; a plurality of light-emitting elements disposed on the display area, wherein each light-emitting element is disposed at an intersection between the first electrode and the second electrode so that the light-emitting element provides a pixel; a first circuit for selecting a part of the plurality of first electrodes, for controlling the part of the plurality of first electrodes to be in the conductive state, and for changing the part of the plurality of first electrodes sequentially so that the first circuit scans the plurality of first electrodes in a predetermined scanning period; a second circuit for deciding a part of the plurality of second electrodes with respect to the scanning period, the part of the plurality of second electrodes corresponding to a part of the plurality of light-emitting elements for emitting a light, and for connecting the part of the plurality of second electrodes to the driving current source with respect to the scanning period; a plurality of light-emission adjustment elements disposed on a part of the display unit other than the display area, wherein each adjustment element is coupled with the second electrode to be in parallel with the light-emitting element so that a part of the driving current passing through the second electrode branches from the other part of the driving current to be supplied to the light-emitting element, and wherein the part of the driving current provides an adjustment current; and a light-emission adjustment controller for controlling the light to be emitted from each light-emitting element in such a manner that the light-emission adjustment controller controls the adjustment current passing through each light-emission adjustment element so that the other part of the driving current to be supplied to the light-emitting element is adjusted.

In the above passive matrix type display device, the driving current flows through the second electrodes with controlling amount of the driving current. A part of the driving current as an adjustment current is branched to the light-emission adjustment elements. Thus, although the total amount of the driving current flowing through the second electrodes is constant, the amount of the driving current to be supplied to each light emitting element connecting to the second electrode is changeable. Thus, a ratio between the driving current to be supplied to the light emitting element and the adjustment current is increased so that the light emitted from the light emitting elements is preferably lowered. Thus, the light adjustment function can perform the light adjustment control of a low intensity side stably and inexpensively. Further, since the light-emission adjustment elements are disposed outside of the display area, layout of the light emitting elements in the display area is sufficiently prepared and has high design degree of freedom. Thus, integration density of the light emitting elements in the display area is appropriately designed.

BRIEF DESCRIPTION OF THE DRAWINGS

The above and other objects, features and advantages of the present invention will become more apparent from the following detailed description made with reference to the accompanying drawings. In the drawings:

FIG. 4 is a perspective view showing the light emitting element;

FIG. 5A is a cross sectional view showing a light adjustment element according to a first example, and 5B is a table showing materials in the light adjustment element;

FIG. 17 is a schematic view showing a chemical compound No. 3;

FIG. 18 is a schematic view showing a chemical compound No. 4;

FIG. 19 is a schematic view showing a chemical compound of rubren; and

FIG. 20 is a table showing electrical properties of various compounds.

DETAILED DESCRIPTION OF THE PREFERRED EMBODIMENTS

First Embodiment

Now, embodiments of the present invention will be described with reference to the drawings.

Figure 1:
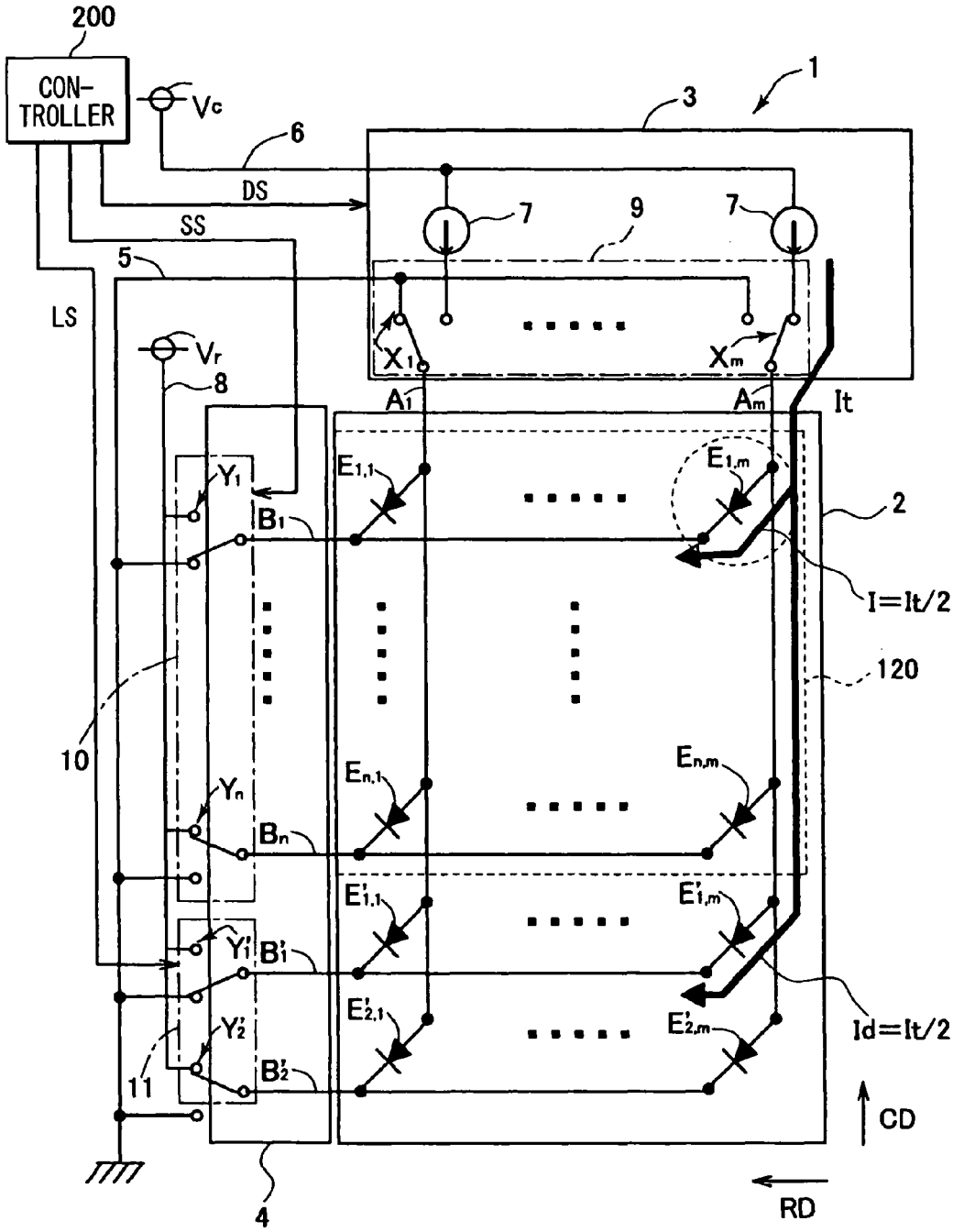
FIG. 1 is a circuit diagram showing a passive matrix type display device according to a first embodiment.
Figure 14:
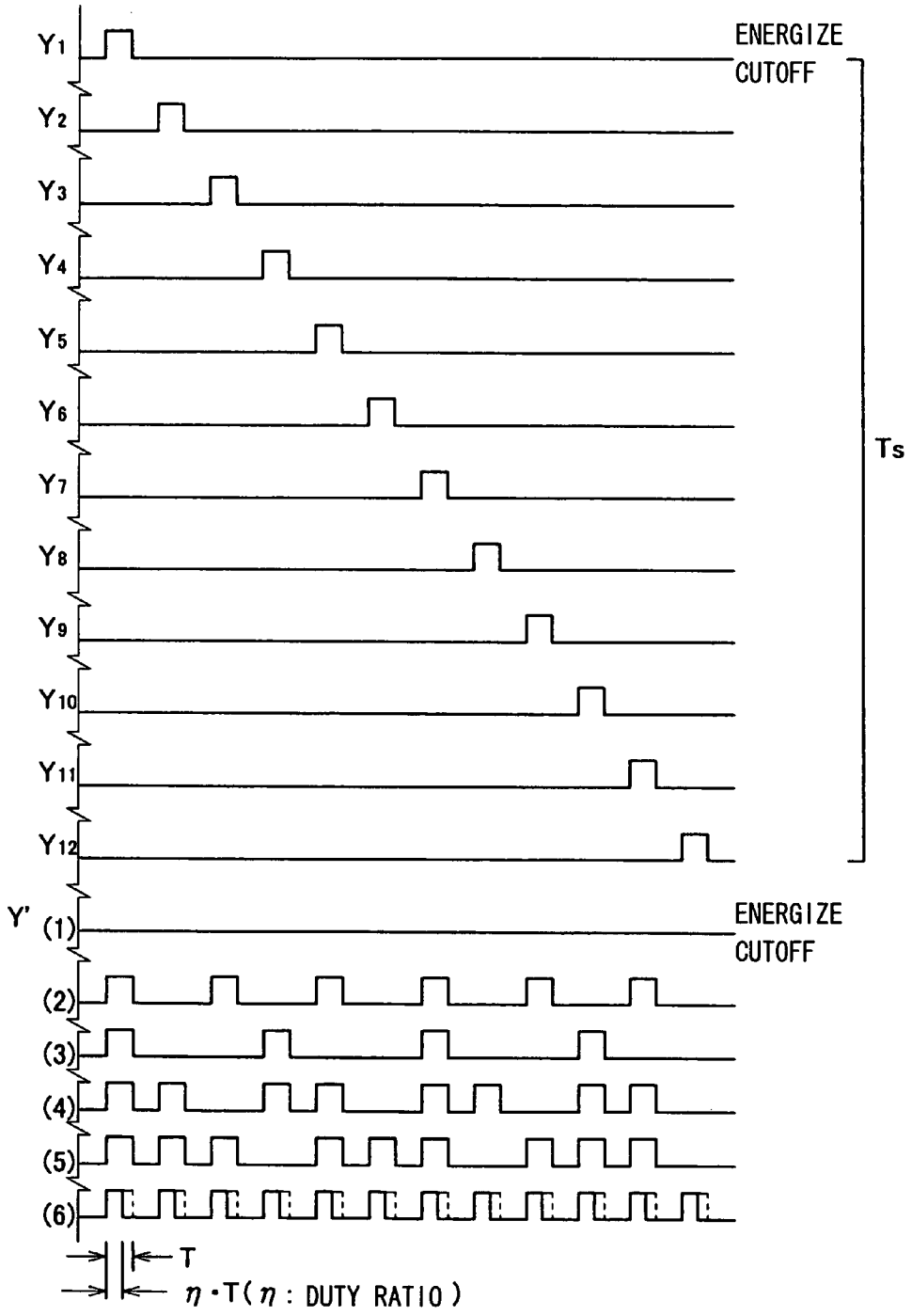
FIG. 14 is a timing chart showing energization patterns in the light adjustment element.

FIG. 1 is a circuit diagram showing one embodiment of a passive matrix type display device 1 according to the first embodiment. The passive matrix type display device 1 is configured including the following constituents:

scanning electrodes B (indicated as $B_1$, $B_2$, . . . , and $B_n$ in the figure, in order to distinguish a plurality of ones on an array), wherein a plurality of scanning electrodes are arrayed at preset intervals in a first direction CD within a display area 120, and each of them is disposed so that it can be changed-over between a light-emission connection state capable of conducting a drive current I and a non-light-emission connection state incapable of conducting the drive current I;

data electrodes A (indicated as $A_1$, $A_2$, . . . , and $A_m$ with suffixes in the figure, in order to distinguish a plurality of ones on an array), wherein a plurality of data electrodes are arrayed at preset intervals in a second direction RD intersecting the first direction CD, within the display area 120;

drive current source, wherein the individual data electrodes A are connected to the drive current source so that each of them can be changed-over between a light-emission connection state capable of conducting a total current It and a non-light-emission connection state incapable of conducting the total current It, wherein the drive current source feeds currents to the data electrodes A while controlling conduction current quantities to predetermined values, and wherein this drive current source includes a stabilized power source Vc (or a battery +B), and constant-current circuits 7 which are connected to the stabilized power source Vc so as to individually correspond to the data electrodes $A_1$, $A_2$, . . . , and $A_m$;

light emitting elements E (indicated as $E_{1,1}$, $E_{2,1}$, . . . , $E_{n,1}$, . . . , etc. with two-dimensional array suffixes in the figure, in order to distinguish a plurality of ones on a two-dimensional array), wherein the light emitting elements are formed at the intersection positions between the scanning electrodes $B_1$, $B_2$, . . . , and $B_n$ and the data electrodes $A_1$, $A_2$, . . . , and $A_m$ within the display area 120, and they define display pixels, wherein, in this embodiment, the light emitting elements are configured as organic EL elements, and wherein the detailed structure of each light emitting element will be explained later;

scanning drive circuit 10, wherein the scanning drive circuit 10 scans and drives the plurality of scanning electrodes $B_1$, $B_2$, . . . , and $B_n$ every predetermined scanning cycle so that only selected ones of the scanning electrodes $B_1$, $B_2$, . . . , and $B_n$ may fall into the light-emission connection states, and that the scanning electrodes $B_k$ to be selected may be successively changed-over on the array thereof, wherein the scanning switch circuit 10 is configured of a group of SPDT switches $Y_1$, $Y_2$, . . . , and $Y_n$ which connect the distal ends of the respectively corresponding scanning electrodes $B_1$, $B_2$, . . . , and $B_n$ either to ground (corresponding to the light-emission connection states) or to a reverse bias supply voltage (corresponding to the non-light-emission connection states), wherein, as shown in FIG. 14, the SPDT switches $Y_1$, $Y_2$, . . . , and $Y_n$ are successively changed-over into the light-emission connection states (current conduction states) at predetermined time intervals within the scanning cycle $T_s$ of one frame (one field in case of an interlaced scheme) by receiving a scanning signal SS from a control circuit 200, wherein, incidentally, a predetermined non-display period (a period during which all the scanning electrodes $B_1$, $B_2$, . . . , and $B_n$ fall into cutoff states) is set between adjacent frames;

data drive circuit 9, wherein the data drive circuit 9 connects a specified one of the data electrodes A as is determined in accordance with any of the light emitting elements E to emit light, selectively to the drive current source every scanning cycle, wherein this data drive circuit 9 is configured of a group of SPDT switches $X_1$, $X_2$, . . . , and $X_n$ which connect the end parts of the respectively corresponding data electrodes $A_1$, $A_2$, . . . , and $A_m$ on the power source connection sides thereof, selectively either to the drive current source sides thereof (corresponding to lit-up states) or to the ground sides thereof (corresponding to put-out states), wherein, in operation, the data drive circuit 9 sets the switches X which correspond to the light emitting elements to be lit up in the respective selection periods of the scanning electrodes $B_1$, $B_2$, . . . , and $B_n$, selectively at lit-up state positions by receiving a data signal DS from the control circuit 200, wherein, concretely, the data drive circuit 9 detects a horizontal sync signal corresponding to the selected scanning electrode B, it counts pixel transfer clocks with reference to the horizontal sync signal, thereby to specify the data electrode A corresponding to each display pixel, and it gives the command of the changeover of the SPDT switch X corresponding to the data electrode A, on the basis of the binary pulse level of display data expressive of the lit-up state of the pixel (light emitting element E) corresponding to the pertinent data electrode A;

light adjustment elements E' (indicated as $E'_{1,1}$, $E'_{2,1}$, . . . , etc. with two-dimensional array suffixes in the figure, in order to distinguish a plurality of ones on a two-dimensional array), wherein the light adjustment elements E' are disposed outside the display area 120, and they are connected in parallel with the light emitting elements E in each of the data electrodes A, whereby part of the total current It fed from the drive current source 7 through the data electrode A can be distributively conducted as a light adjustment current Id, wherein the data electrode A is connected to the constant-current circuit 7, and the total current It on the data electrode A is held constant, wherein in a case where the light adjustment current Id flows through the data electrode $A_i$, a remaining current obtained by subtracting the light adjustment current Id from the total current It is the drive current I (=It−Id), which is conducted to the light emitting elements $E_{i,j}$ corresponding to the selected scanning electrode $B_j$, wherein the details of the structure of each light adjustment element E' will be explained later; and light adjustment control means 11, wherein the light adjustment control means 11 alters the distributive conduction quantity of the light adjustment current Id to the light adjustment elements E', thereby to adjust the conduction quantity of the drive current I to the light emitting elements E on the corresponding data electrode A and to adjust the lights of the respective light emitting elements E, wherein the plurality of light adjustment elements $E'_{1,1}$, $E'_{1,2}$, . . . corresponding to the data electrodes $A_1$, $A_2$, . . . , and $A_m$ are connected in parallel with each other, at the intersection positions between light adjusting electrodes $B'_1$ and $B'_2$ and the respective data electrodes $A_1$, $A_2$, . . . , and $A_m$ by the light adjusting electrodes $B'_1$ and $B'_2$ which are arranged in adjacency at the distal end of the array of the scanning electrodes $B_1$, $B_2$, . . . , and $B_n$, wherein the light adjustment control means 11 alters the distributive conduction quantity of the light adjustment current Id through the light adjusting electrodes B'.

Each of the light adjusting electrodes B' can be changed-over between a first connection state capable of conducting the light adjustment current Id and a second connection state incapable of conducting the light adjustment current Id, and the light adjustment control means 11 functions as light adjusting changeover control means for changing-over the light adjusting electrodes B' between the first connection states and the second connection states. Concretely, the light adjustment control means 11 being the light adjustment switching circuit is configured of a group of SPDT switches $Y'_1$ and $Y'_2$ which connect the distal ends of the respective light adjusting electrodes $B'_1$ and $B'_2$ selectively either to the ground (corresponding to the current conduction states) or to the reverse bias supply voltage (corresponding to the cutoff states). The light adjustment control means 11 receives a light adjustment signal LS from the control circuit 200, and it subjects the group of SPDT switches $Y'_1$ and $Y'_2$ to the changeover control so that the light adjustment current Id corresponding to the content of the light adjustment signal LS may flow. Here, in FIG. 1, reference numeral 2 represents a display unit, reference numeral 3 represents a vertical unit, reference numeral 4 represents a horizontal unit, and reference numeral 6 represents a wire.

As shown in FIG. 4, the plurality of organic EL elements E are made unitary by an organic stacked body 150 which consists of a plurality of layers that are respectively formed continuously in the in-plane direction of the display area. The organic stacked body 150 which is shared by the individual light emitting elements E is formed by a vapor deposition method such as evaporation or high-frequency sputtering (effective in case of using low-molecular materials) or a solution coating method (effective in case of using molecular materials). The group of scanning electrodes B are arranged on one principal surface of the organic stacked body 150, while the group of data electrodes A are arranged on the other principal surface of the organic stacked body 150.

Figures 3A, 3B:
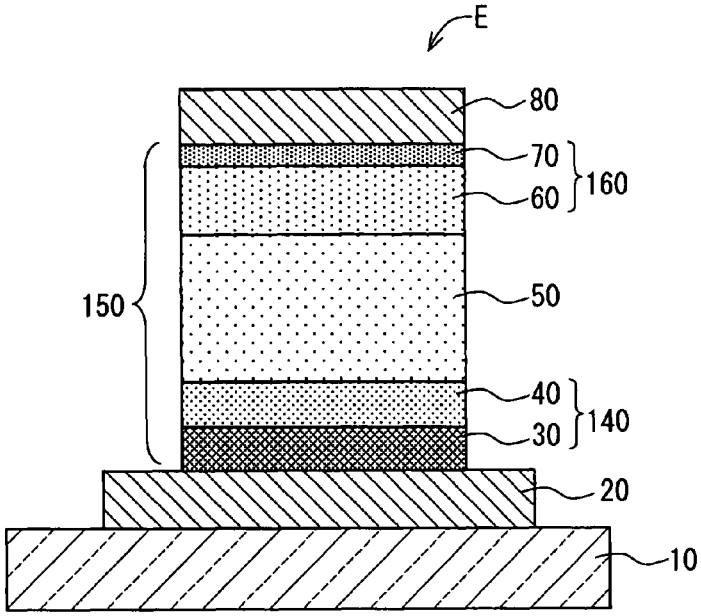
FIG. 3A is a cross sectional view showing a light emitting element.
FIG. 3B is a table showing materials in the light emitting element.

FIGS. 3A and 3B schematically show the sectional structure of one of the organic EL elements E. The organic EL element E is formed on a glass substrate 10 which forms a base material. The data electrode A which is connected to the drive current source is an anode 20, while the scanning electrode B and light adjusting electrode B' which are grounded is a cathode. The anode 20 is made of a material of large work function $\phi$ so that the injection of holes into the organic stacked body 150 may proceed easily. In this embodiment, the anode 20 is made of ITO (Indium-Tin Oxide), but it may well be another oxide layer of zinc oxide, indium-zinc oxide, or the like. Besides, the cathode 80 needs to be small in work function $\phi$ so that the injection of electrons into the organic stacked body 150 may proceed easily. In this embodiment, the cathode 80 is made of Al (aluminum), but it is also possible to use an alloy (for example, Al—Li) in which the Al is doped with a metal smaller in work function than the Al, or an alloy such as Mg—In or Mg—Ag.

Figure 13:
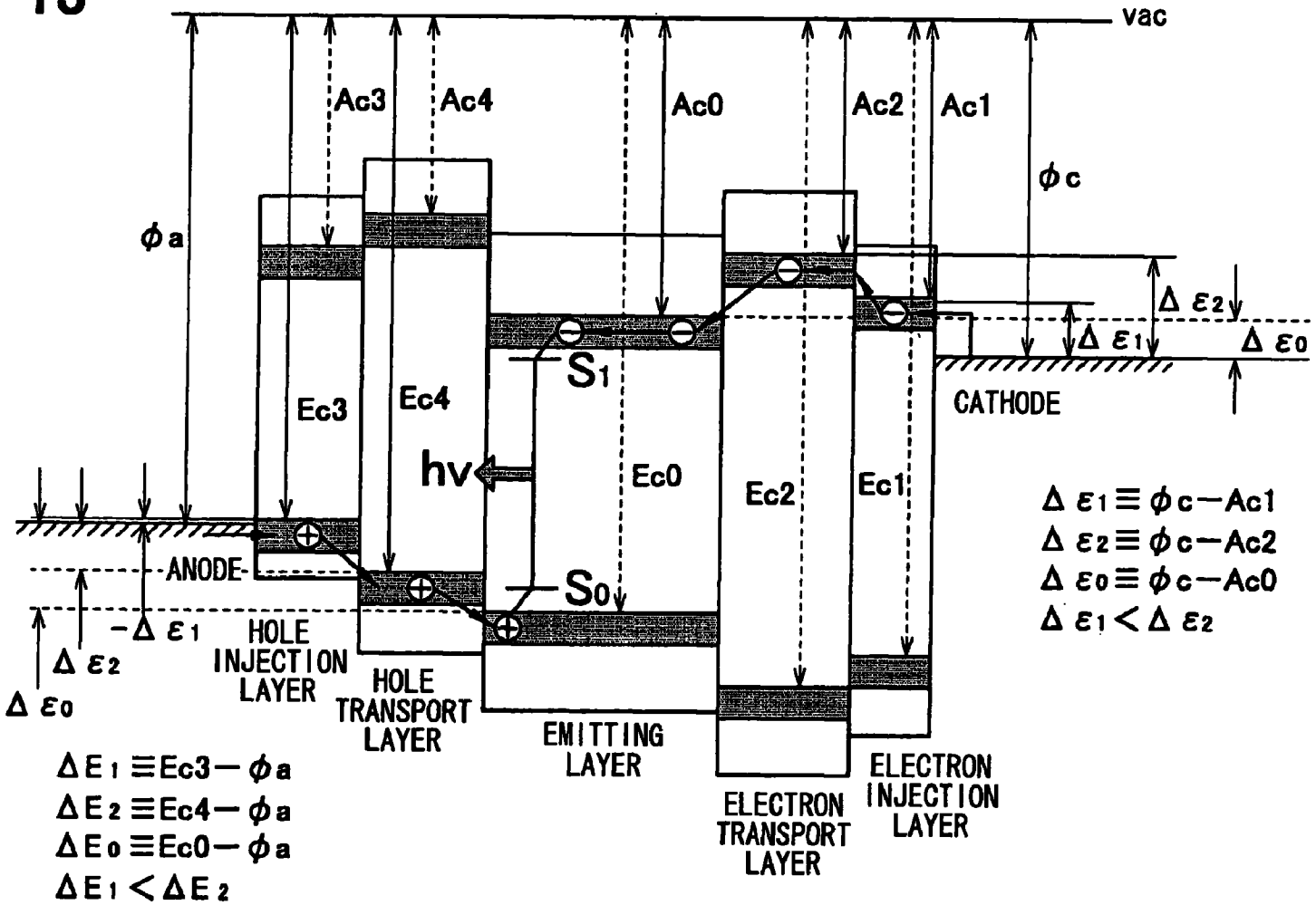
FIG. 13 is a diagram showing energy level in the passive matrix type display device according to the fourth embodiment.

The organic stacked body 150 has a well-known structure in which an electron transportable material layer 160, a light emitting layer 50 and a hole transportable material layer 140 are stacked in this order from the side of the cathode 80. FIG. 13 schematically shows the energy structure of the organic stacked body 150. The electron transportable material layer 160 is arranged in contact with the cathode 80 and an electron transport layer 60 which is arranged in touch with the light emitting layer 50, and it has an electron injection layer 70 as to which the difference $\Delta\epsilon 1 \equiv \phi c - Ac1$ between the electron affinity Ac1 of its own and the work function $\phi c$ of the cathode 80 is smaller than the difference $\Delta\epsilon 2 \equiv \phi c - Ac2$ between the electron affinity Ac2 of the electron transport layer 60 and the work function $\phi c$ of the cathode 80. Thus, the levels of energy barriers pertinent to electron injections as are formed between the individual layers in the section between the cathode 80 and the light emitting layer 50 are decreased. Besides, in order to make difficult the occurrence of hole injection from the light emitting layer 50 into the electron transport layer 60, this electron transport layer 60 is selected so that the difference $\delta E2$ ($\equiv Ec2 - Ec0$) between the ionization potential Ec2 thereof and the ionization potential Ec0 of the light emitting layer 50 may become larger than the difference $\delta E4$ ($\equiv Ec0 - Ec4$) between the ionization potential Ec4 of a hole transport layer 40 to be stated later and the ionization potential Ec0 of the light emitting layer 50. Thus, the effect of confining holes in the light emitting layer 50 is heightened, and it contributes to enhancing the light-emission recombination probability of electrons—holes in the light emitting layer 50.

Well-known materials can be adopted as the constituent materials of the electron transport layer 60 and the electron injection layer 70. For the electron transport layer 60, it is possible to adopt an organic material composed of, for example, an aluminum-quinolinol complex (a concrete example of which is tris(8-quinolato) aluminum (so-called "Alq3")) or an anthracene derivative. Besides, the electron injection layer 70 can be made of an alkali metal (such as Li, Na, K or Cs), alkaline earth metal (such as Be, Mg, Ca, Sr or Ba), or any of the inorganic compounds (for example, oxide ($Li_2O$ or the like) or halide (LiF or the like) of such metals.

Next, the hole transportable material layer 140 is arranged in contact with the anode 20 and the hole transport layer 40 which is arranged in touch with the light emitting layer 50, and it can be configured having a hole injection layer 30 as to which the difference $\Delta E1 \equiv Ec3 - \phi a$ between the ionization potential Ec3 of its own and the work function $\phi a$ of the anode 20 is smaller than the difference $\Delta E2 \equiv Ec4 - \phi a$ between the ionization potential Ec4 of the hole transport layer 40 and the work function $\phi a$ of the anode 20. Thus, the levels of energy barriers pertinent to hole injections as are formed between the individual layers in the section between the anode 20 and the light emitting layer 50 are decreased, and this contributes to lowering the drive voltage of the element. Besides, in order to make difficult the occurrence of electron injection from the light emitting layer 50 into the hole transport layer 40, this hole transport layer 40 is selected so that the difference $\delta E4$ ($\equiv Ac0 - Ac4$) between the electron affinity Ac0 of the light emitting layer 50 and the electron affinity Ac4 of this hole transport layer 40 may become larger than the difference $\delta E2$ ($\equiv Ac2 - Ac0$: in FIG. 13, this value is a minus value, and an ohmic contact is established concerning electron transport) between the electron affinity Ac2 of the electron transport layer 60 and the electron affinity Ac0 of the light emitting layer 50. Thus, the effect of confining electrons in the light emitting layer 50 is heightened, and it contributes to enhancing the light-emission recombination probability of electrons—holes in the light emitting layer 50. Here, $\Delta\epsilon 0 \equiv \phi c - Ac0$, $\Delta\epsilon 1 < \Delta\epsilon 2$, $\Delta E0 \equiv Ec0 - \phi a$, and $\Delta E1 < \Delta E2$.

Figure 15:
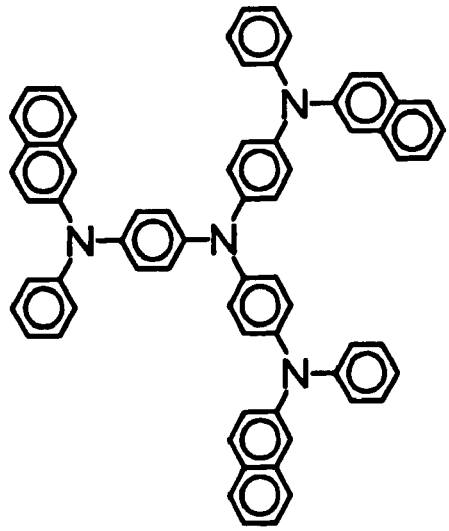
FIG. 15 is a schematic view showing a chemical compound No. 1.

Well-known materials can be adopted as the constituent materials of the hole transport layer 40 and the hole injection layer 30. The hole injection layer 30 can be made of, for example, copper phthalocyanine, or a compound I whose structure is represented by the chemical formula No. 1 shown in FIG. 15.

Figure 16:
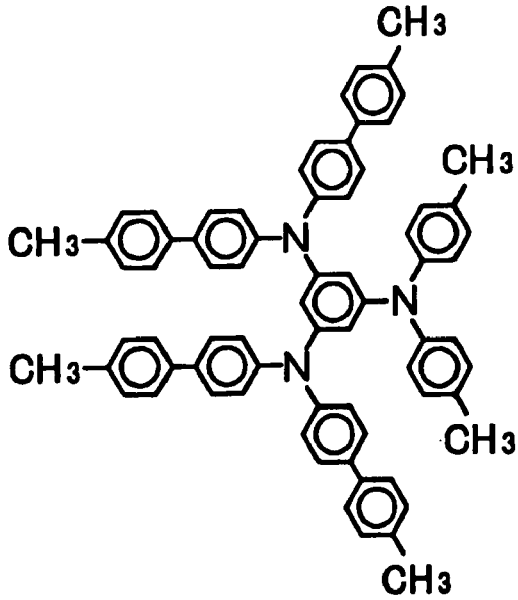
FIG. 16 is a schematic view showing a chemical compound No. 2.

Besides, the hole transport layer 40 can be made of a triphenylamine compound, for example, a compound II whose structure is represented by the chemical formula No. 2 shown in FIG. 16, or a compound III whose structure is represented by the chemical formula No. 3 shown in FIG. 17.

Figures 7A, 7B:
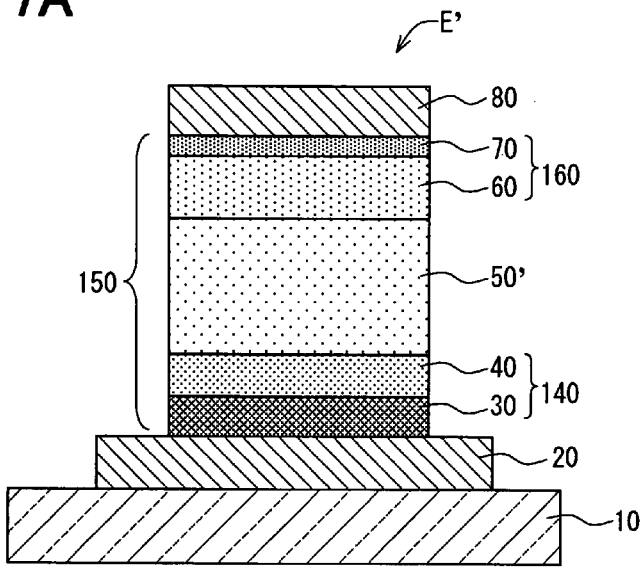
FIG. 7A is a cross sectional view showing a light adjustment element according to a third example, and 7B is a table showing materials in the light adjustment element.

The light emitting layer 50 selects as its host material, a material in which an electron mobility is higher than a hole mobility (that is, an electron transportable material), whereby the recombination of electrons and holes occurs effectively near the interface of this light emitting layer 50 with the hole transport layer, and a light emission efficiency can be heightened. Any of various materials including the aluminum-quinolinol complex (for example, Alq3) mentioned above, a compound IV which is represented by the chemical formula No. 4 shown in FIG. 18, etc. can be adopted as such an electron transportable material constituting the light emitting layer 50:

Besides, the light emitting layer 50 can be formed as one whose host material is doped with a dopant (guest material) enhancing a fluorescent quantum yield. Thus, the light emission efficiency of the light emitting element E is heightened, and this contributes to the enhancement of an element lifetime. A well-known material can be adopted as such a dopant, and it is possible to adopt, for example, rubren having a structure represented by the chemical formula No. 5 shown in FIG. 19, or a coumarin derivative, DCM or quinacridone:

In FIG. 1, each light adjustment element E' is formed by utilizing at least one layer of the organic stacked body 150 in FIG. 4 or FIGS. 7A and 7B. As stated before, the individual organic material layers constituting the organic stacked body 150 (in FIGS. 3A and 3B, the hole injection layer 30, hole transport layer 40, light emitting layer 50 and electron transport layer 60) are formed by the vapor deposition method such as evaporation or high-frequency sputtering (effective in case of using low-molecular materials) or the solution coating method (effective in case of using molecular materials). Such a process has the advantage that the layer or layers to be utilized for the light adjustment elements E' can be collectively formed at the formation of the light emitting elements E.

From this viewpoint, a part of layers of the organic stacked body 150 is omitted or is replaced with a layer made of another material, whereby the light adjustment element E' can be formed in various aspects as an element which exhibits a light emission intensity lower than that of the light emitting element E when both the elements are driven by an identical voltage, or as an element which does not emit light. In the case where the organic stacked body 150 forming the light emitting element E is configured as shown in FIGS. 3A and 3B, the light adjustment element E' can effectively suppress its light emission by omitting at least the light emitting layer 50 or replacing it with the layer made of the other material.

FIGS. 5A, 5B, 6A, and 6B show examples in each of which the light adjustment element E' is configured by omitting the light emitting layer 50 from the organic stacked body 150 in FIGS. 3A and 3B and at least the electron transport layer 60 from the electron transportable material layer 160, and leaving the hole transportable material layer 140 behind. Although the hole transportable material layer 140 is low in the light emission recombination probability, it is favorable in an electric conductivity itself originating from the hole transport. Accordingly, the light adjustment element E' which is of non-light emission type and whose current conduction capacity is comparatively large can be easily configured by the omissions of the light emitting layer 50 and electron transport layer 60. The light adjustment element E' in FIGS. 5A and 5B has a structure in which the electron injection layer 70 is further omitted. In this case, the electron injection energy barrier between the cathode 80 and the organic layer is rather increased by the omission of the electron injection layer 70, but holes are injected into the hole transportable material layer 140 more dominantly owing to the increased electron injection energy barrier. Therefore, unnecessary light-emission recombination becomes difficult to occur, and this is more convenient as the light adjustment element E'.

In either of the configurations in FIGS. 5A. 5B, 6A and 6B, the hole transportable material layer 140 included in the light adjustment element E' can be configured of, at least, either of the hole transport layer 40 and the hole injection layer 30. That is, although the light adjustment element E' succeeds to the partial structure of the light emitting element E, it no longer has any requirement concerning the enhancement of a light emitting function, and hence, it need not always be optimized so as to compare favorably with the light emitting element E in point of an energy barrier profile pertinent to the hole injection between the hole transportable material layer 140 and the anode 20. By way of example, the light adjustment element E' which utilizes only the hole injection layer 30 in the hole transport layer 40 and hole injection layer 30 of the light emitting element E has the advantage that an energy barrier for the hole injection from the anode 20 into the hole injection layer 30 can be made small. However, the light adjustment element E' can adopt a configuration in which only the hole transport layer 40 is utilized by omitting the hole injection layer 30, or it may well succeed to the stacked structure consisting of the hole injection layer 30 and the hole transport layer 40.

In a case where the anode 20 and the cathode 80 are respectively made of ITO and Al, the ionization potentials (Ec) and electron affinities (Ac) of the compounds I, II and III mentioned before, the work functions of the ITO and Al (denoted by $\phi$ below), the values Ec/Ac of the respective compounds, and the differences of the electron affinities from the work functions $\phi$ of the ITO or Al are collectively listed as indicated in Table 1 shown in FIG. 20. A minus value in the table signifies that any energy barrier is not existent, and that an ohmic contact is established between the compound and the electrode.

In the case of the organic EL element, holes are injected from the anode into the organic layer, and electrons are injected from the cathode into the organic layer. The injected holes and electrons are recombined in the organic layer, whereby light is emitted. In view of Table 1, the difference between the ionization potential Ec of each compound and the work function $\phi$ of the anode is smaller than the work function $\phi$ of the cathode and the electron affinity Ac of each compound, so that the electron injection energy barrier becomes relatively larger. Therefore, in the structure (FIGS. 5A and 5B) in which the hole transportable material layer 140 made of the compounds is sandwiched in between the anode and the cathode, the holes are injected more easily than the electrons, with the result that the structure functions as a hole current device, and the holes and the electrons are recombined in the organic layer at almost no probability. Accordingly, the structure becomes the device which emits no light in principle.

Figures 6A, 6B:
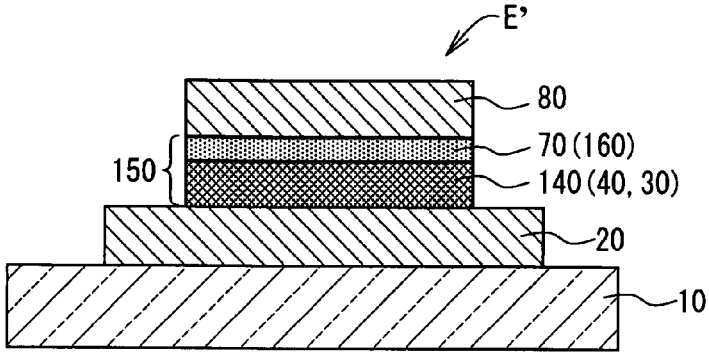
FIG. 6A is a cross sectional view showing a light adjustment element according to a second example, and 6B is a table showing materials in the light adjustment element.

Incidentally, when the electron injection layer 70 is inserted between the cathode 80 and the hole transportable material layer 140 as shown in FIGS. 6A and 6B, an electron injection energy barrier at the interface of the electron injection layer 70 with the cathode 80 lowers. Therefore, electrons are easily injected into the hole transportable material layer 140, and the light-emission recombination which is undesirable as the light adjustment element E' is sometimes liable to occur. Accordingly, it is more desirable to omit the electron injection layer 70 as shown in FIGS. 5A and 5B. Since the triphenylamine compound which is employed as the hole transport material is comparatively small in the ionization potential Ec and the electron affinity Ac, the hole injection energy barrier thereof with respect to the ITO forming the anode 20 is small, and the electron injection energy barrier thereof with respect to the Al forming the cathode 80 can be set large. Therefore, with the structure of FIGS. 5A and 5B in which such a hole transport material is sandwiched in between the electrodes, the hole current device can be easily obtained.

Next, the light adjustment element E' in FIGS. 7A and 7B is an example of a configuration in which the light emitting layer 50 in the organic stacked body 150 is replaced with a substitute organic layer 50' having a dopant added thereto in a quantity smaller than in the light emitting layer 50. Thus, unnecessary light emission in the light adjustment element E' can be effectively suppressed. In FIGS. 7A and 7B, the substitute organic layer 50' is not doped with rubren which the light emitting layer 50 in FIGS. 3A and 3B contains as the dopant, and the light emission thereof is suppressed.

Figures 8A, 8B:
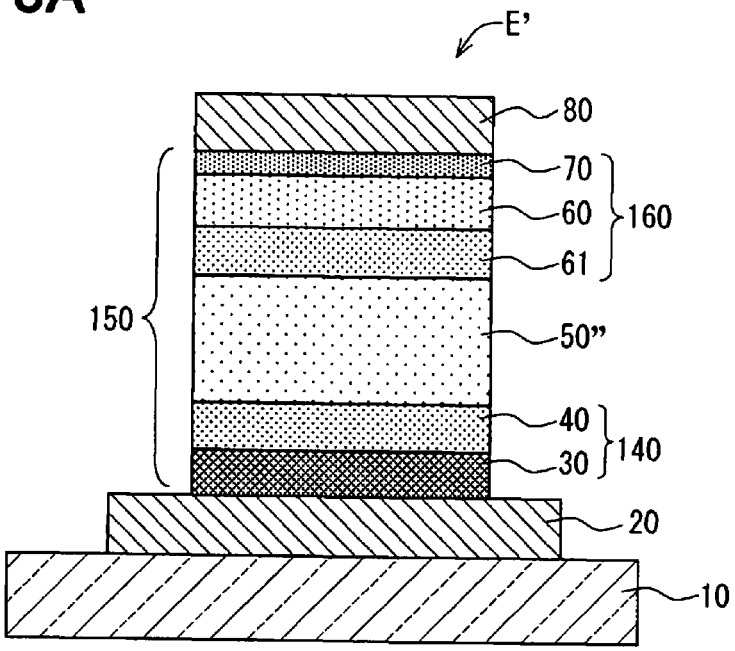
FIG. 8A is a cross sectional view showing a light adjustment element according to a fourth example, and 8B is a table showing materials in the light adjustment element.
Figures 9A, 9B:
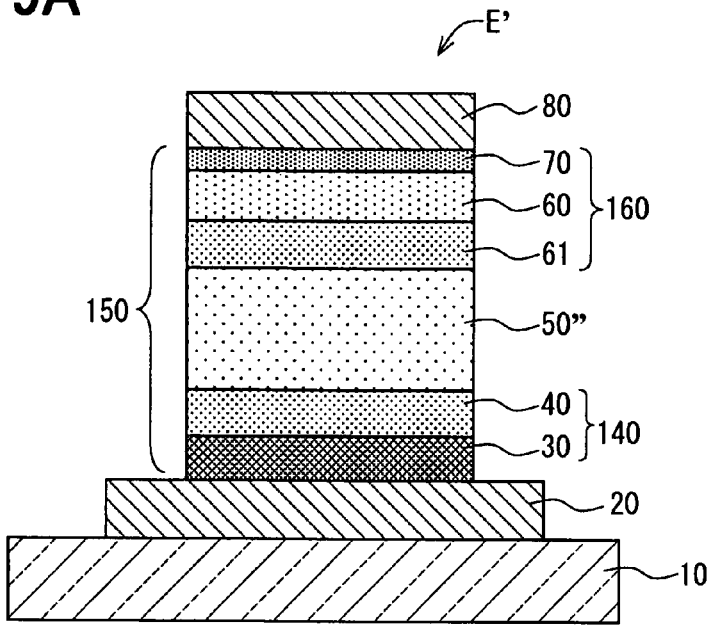
FIG. 9A is a cross sectional view showing a light adjustment element according to a fifth example, and 9B is a table showing materials in the light adjustment element.

Besides, a light adjustment element E' in FIGS. 8A and 8B is such that the light emitting layer 50 of the organic stacked body 150 is replaced with a substitute organic layer 50" which is made of a mixture consisting of an electron transportable organic material and a hole transportable organic material. In the case where the light emitting layer 50 of the light emitting element E is replaced with the substitute organic layer 50" which is made of the mixture consisting of the electron transportable organic material and the hole transportable organic material, electrons and holes injected into the substitute organic layer 50" migrate in a manner to be respectively localized in the regions of an electron transportable organic material phase and the regions of a hole transportable organic material phase as exist in mixed and dispersed fashion within the substitute organic layer 50". As a result, a probability at which the carriers undergo light-emission recombination with each other within the layer 50" is lowered, but the mobilities themselves of the corresponding carriers in the respective phase regions are high. Therefore, unnecessary light emission in the light adjustment element E' can be effectively suppressed with a favorable conductivity ensured.

Concretely, the organic stacked body 150 of the light emitting element E in FIGS. 3A and 3B is considered as a structure to be referred to, and the substitute organic layer 50" of the light adjustment element E' in FIGS. 8A and 8B is configured in such a way that the hole transportable organic material (compound II or III) forming the hole transportable material layer 140 is mixed into the electron transportable organic material (compound IV) forming the light emitting layer 50. The constituent materials of the substitute organic layer 50" can be shared with the electron transportable organic material forming the light emitting layer 50 and the hole transportable organic material forming the hole transportable material layer 140. Especially in case of configuring the substitute organic layer 50" by the vapor deposition method, any material source dedicated to the substitute organic layer 50" need not be assembled into a deposition equipment, and a deposition process and the deposition equipment can be simplified.

Concretely, the light adjustment element E' is provided with a hole transport layer 40 in contact with the anode 20 side of the substitute organic layer 50", while it is provided with a sub electron transport layer 61 made solely of the electron transportable organic material (compound IV) forming the light emitting layer 50, in contact with the cathode 80 side of the substitute organic layer 50", and it is further provided with the same electron transport layer 60 and electron injection layer 70 as those of the light emitting element E, in contact with the cathode 80 side of the sub electron transport layer 61. As compared with the light emitting layer 50 of the light emitting element E, the substitute organic layer 50" of the light adjustment element E' becomes larger in the difference of an electron conduction level relative to the electron transport layer 60, in correspondence with the component of the hole transportable organic material mixed in the electron transportable organic material constituting this substitute organic layer 50". Accordingly, when the substitute organic layer 50" is brought into direct contact with the electron transport layer 60, it has the difficulty that an energy barrier level becomes somewhat high. In this regard, however, the sub electron transport layer 61 made solely of the electron transportable organic material forming the light emitting layer 50 is interposed on the cathode 80 side of the substitute organic layer 50" as stated above, so that the increase of the energy barrier level can be effectively suppressed.

Incidentally, although the substitute organic layer 50" of the light adjustment element E' in FIGS. 8A and 8B is doped with the dopant (rubren) likewise to the light emitting layer 50 of the light emitting element E in FIGS. 3A and 3B, FIGS. 9A and 9B shows an example of a light adjustment element E' in which a substitute organic layer 50" is not doped with the dopant.

There will now be described an actual example of a light adjustment method in the passive matrix type display device 1 shown in FIG. 1. In FIG. 1, each of the light adjusting electrodes B' can be independently changed-over between the current conduction state (first connection state) and cutoff state (second connection state) by the corresponding switch Y'. Any of the groups of light adjustment elements $E'_m$ connected in parallel by the corresponding light adjusting electrodes B' has a current-conducting sectional area identical to that of the light emitting element E. The reason therefor is that the light adjusting electrode B' is configured as the cathode 80 (refer to FIG. 4) identical in width to the scanning electrode B, so the intersection area between the anode 20 forming the data electrode A and the light adjusting electrode B' becomes equal to the intersection area between the former and the scanning electrode B.

Figure 2:
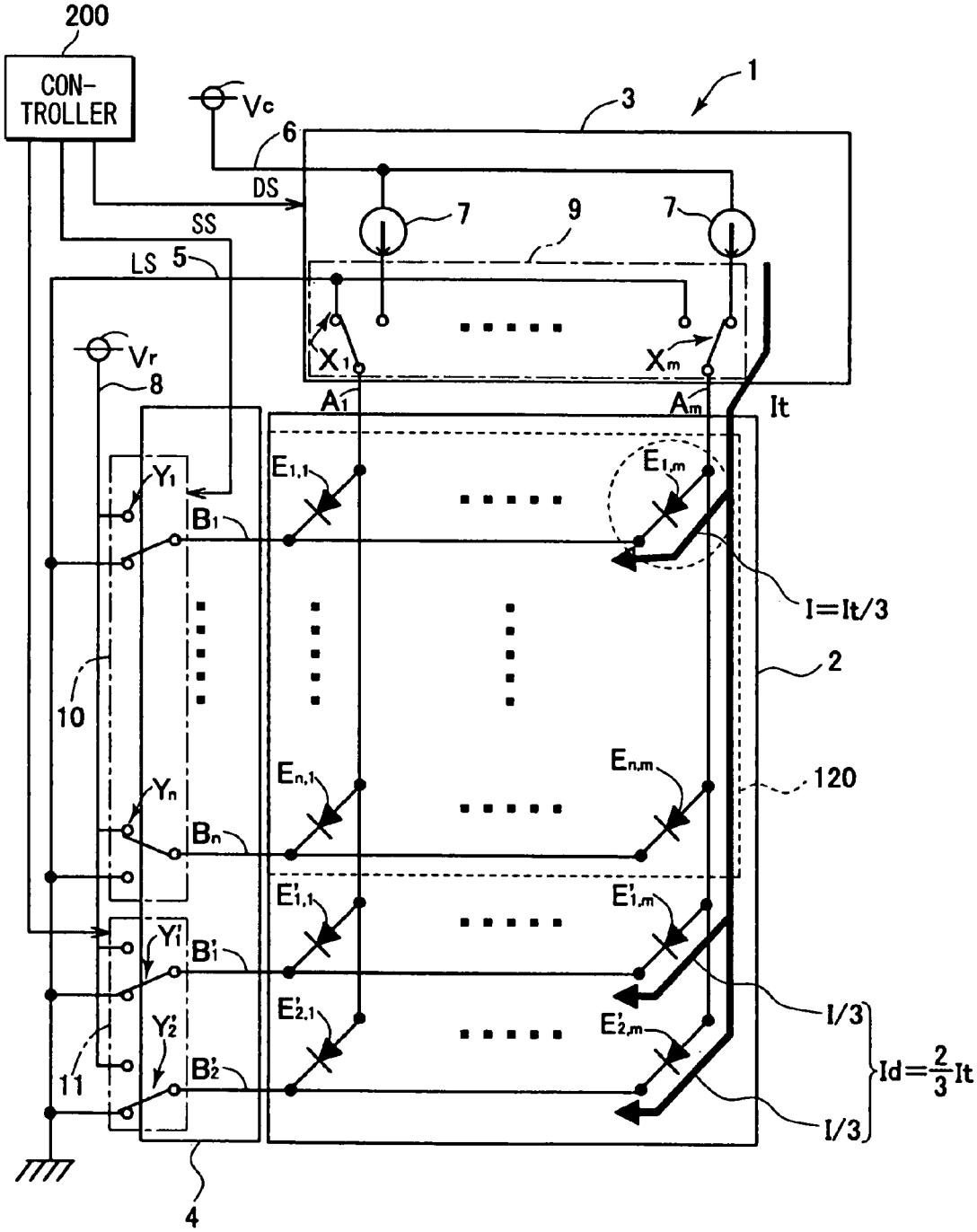
FIG. 2 is a circuit diagram explaining another operational state in the passive matrix type display device according to the first embodiment.

Assuming that all the light adjusting electrodes B' are brought into the cutoff states, the light adjustment current Id which is distributed to the light adjusting electrodes B' becomes zero, and the drive current I becomes It (first light-adjustment-element setting pattern). This drive current is the maximum current which flows to the light emitting element E. In addition, when only the light adjusting electrode $B'_1$ is brought into the current conduction state as shown in FIG. 1, the drive current I which flows to the selected scanning electrode B becomes equal to the light adjustment current Id which is distributed to the light adjusting electrode $B'_1$. Here, since the total current It flowing through the data electrode A is constant, the drive current I becomes It/2 (second light-adjustment-element setting pattern). That is, the light emission quantity of the light emitting element E can be decreased to ½ of the maximum value by bringing only the light adjusting electrode $B'_1$ into the current conduction state. Besides, when the two light adjusting electrodes $B'_1$ and $B'_2$ are both brought into the current conduction states as shown in FIG. 2, the drive current I becomes It/3 considering that the total current It is equally distributed. Thus, the light emission quantity of the light emitting element E can be decreased to ⅓ of the maximum value (third light-adjustment-element setting pattern).

In this manner, the light adjustment elements $E'_m$ connected in parallel by the light adjusting electrodes B' are disposed in the plurality of groups, and the combination of the groups of light adjustment elements $E'_m$ to be connected to the data electrodes A is altered at will, whereby the light adjustment current Id can be easily adjusted to any of the various levels corresponding to the respective combinations. Besides, the first to third light-adjustment-element setting patterns differ from one another in the number of the groups of light adjustment elements $E'_m$ which conduct currents. That is, the number of the light adjusting electrodes B', in turn, the number of the groups of light adjustment elements $E'_m$, to be connected to the data electrodes A is altered, whereby subtle light adjustments are permitted in accordance with the numbers of the groups of light adjustment elements $E'_m$ to be connected. In addition, the individual light adjustment elements E' are formed as having voltage-current characteristics equal to one another. Therefore, as the number of the light adjusting electrodes B' (the groups of light adjustment elements $E'_m$) which are brought into the current conduction states is larger, the light adjustment current Id can be caused to flow more, and a larger light decrease level can be achieved.

Figure 10:
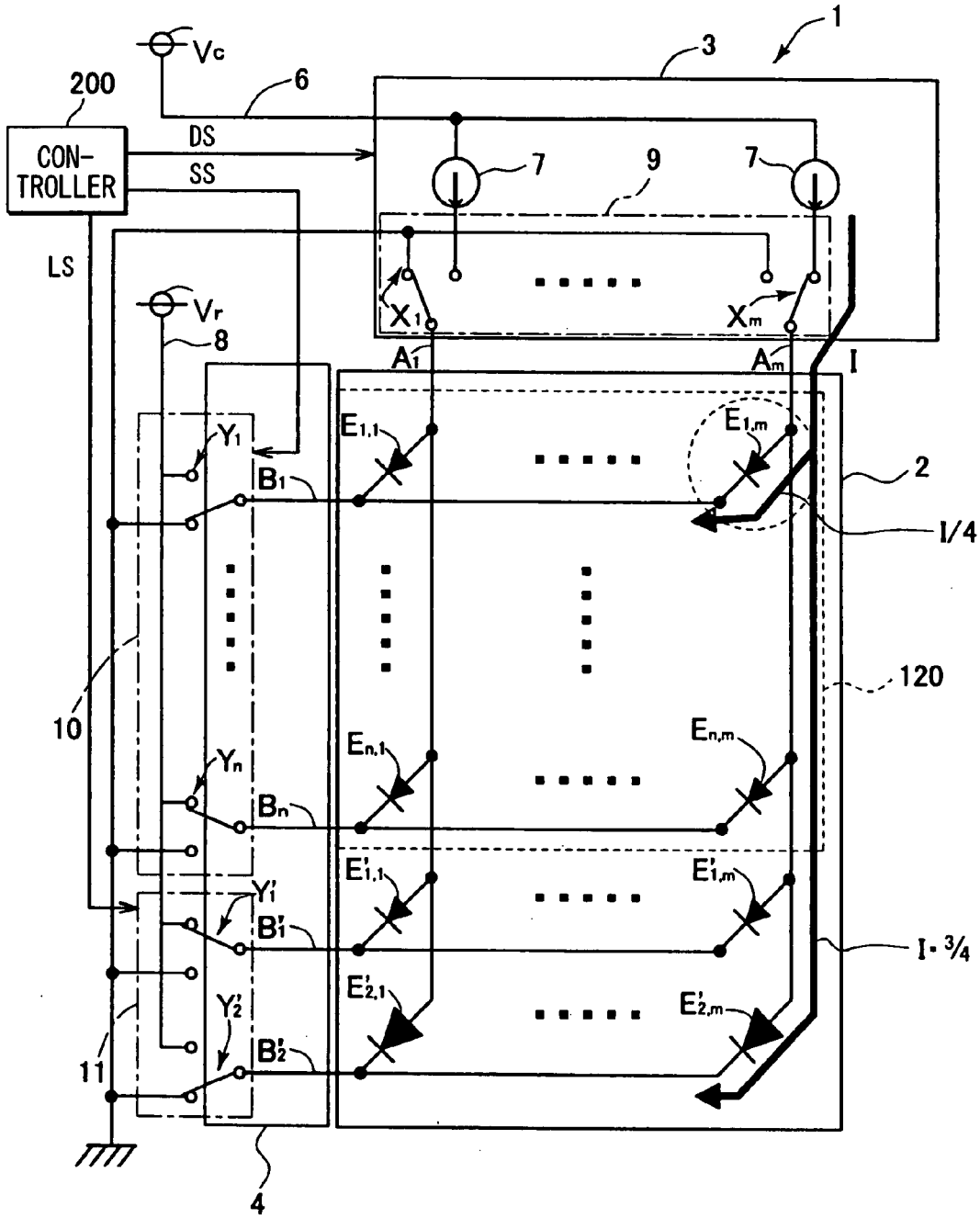
FIG. 10 is a circuit diagram showing a passive matrix type display device according to a second embodiment.

Meanwhile, it is possible to adopt an aspect as shown in FIG. 10, in which a plurality of light adjustment elements E' connected to one light adjusting electrode B' in each group of light adjustment elements $E'_m$ are endowed with voltage-current characteristics equal to one another, and in which at least one of a plurality of light adjustment elements $E'_m$ is configured of light adjustment elements $E'_2$ that are larger in a current-conducting sectional area than those of the remaining groups of light adjustment elements $E'_m$. In this case, the levels of light adjustment currents Id can be collectively increased by selecting the group of light adjustment elements $E'_m$ configured of the light adjustment elements $E'_2$ of larger current-conducting sectional area, and the sorts of settable light adjustment levels and the fluctuation width of the light adjustment levels can be expanded.

In the aspect shown in FIG. 10, each light adjustment element $E'_2$ leading to the light adjusting electrode $B'_2$ has a current-conducting sectional area which is three times as large as that of each light adjustment element $E'_1$ leading to the light adjusting electrode $B'_1$ or each light emitting element E leading to a scanning electrode B. In a case where only the light adjusting electrode $B'_2$ is brought into a current conduction state, a light adjustment current flows three times more than in a case where only the light adjusting electrode $B'_1$ is brought into a current conduction state, and the drive current I of the light emitting element E can be decreased to ¼ of the maximum value at one stroke (that is, light decrease to ¼ is possible). Such a light adjustment element $E'_2$ can be easily fabricated in such a way that the width of the light adjusting electrode $B'_2$ is made larger (three times larger) than the width of the light adjusting electrode $B'_1$ or the scanning electrode B.

Figure 11A:
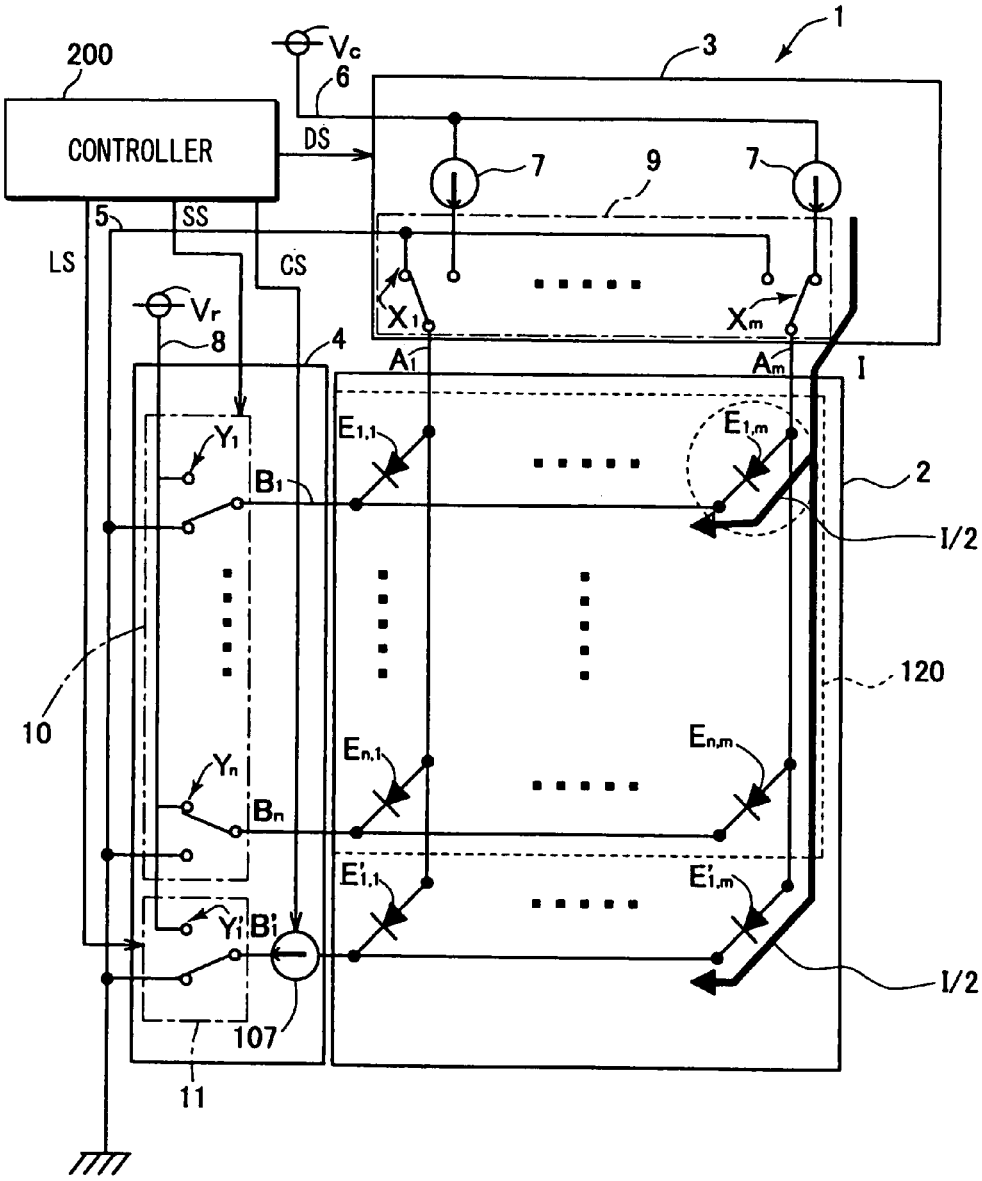
FIG. 11A is a circuit diagram showing a passive matrix type display device according to a third embodiment.

FIG. 11A shows an example provided with a current control circuit 107 by which the quantity of a conduction current to flow on a light adjusting electrode B' is variably controlled in accordance with the number of data electrodes A connected to drive current sources 7. According to this configuration, the quantity of a light adjustment current Id on the light adjusting electrode B' can be adjusted by the current control circuit 107 in accordance with the number of the data electrodes A connected to the drive current sources 7. Therefore, the light adjustment current Id which is conducted to each light adjustment element E' can be stabilized irrespective of the number of the data electrodes A connected to the light adjusting electrode B', and in turn, a stable light adjustment state can be realized.

In the example of FIG. 11A, the current control circuit 107 is disposed at a position at which currents from the individual data electrodes A join on the light adjusting electrode B'. In addition, a total current which flows from the data electrodes A into the current control circuit 107 in the selection period of each scanning electrode B increases in proportion to the number of the data electrodes A connected to the drive current sources, that is, the number of light emitting elements E brought into lit-up states. Accordingly, a control circuit 200 counts the number of levels corresponding to "light-up" among the binary pulse levels of the display data of individual pixels as are successively transferred on the basis of pixel transfer clocks, and it determines a control current level value with reference to the resulting count value, so as to give a command to the current control circuit 107 (control signal CS: here, it is an analog signal indicating an instructive current level). The current control circuit 107 causes the light adjustment current proportional to the number of the light emitting elements E which are brought into the lit-up states, to flow to the light adjusting electrode B' in accordance with the instructive value. Thus, the constant light adjustment currents can be caused to flow to the light adjustment elements E' corresponding to the light emitting elements E to-be-lit-up, irrespective of the number of the light emitting elements E to-be-lit-up on the scanning electrode B.

In this case, a reference light adjustment current value per light adjustment element E' is determined beforehand, and the instructive current level for the current control circuit 107 is adjusted so that the ratio of the light adjustment current to flow through each light adjustment element E', relative to the reference light adjustment current value may change, whereby the light emission level of the light emitting element E can be altered in accordance with the instructive current level. That is, the current control circuit 107 functions as means by which the quantity of the current to flow to the light adjustment element E' through the data electrode A is variably controlled in accordance with a required light adjustment level. Incidentally, when the light adjusting electrode B' is brought into a cutoff state, the light emitting elements E are lit up at the maximum intensity.

Figure 11B:
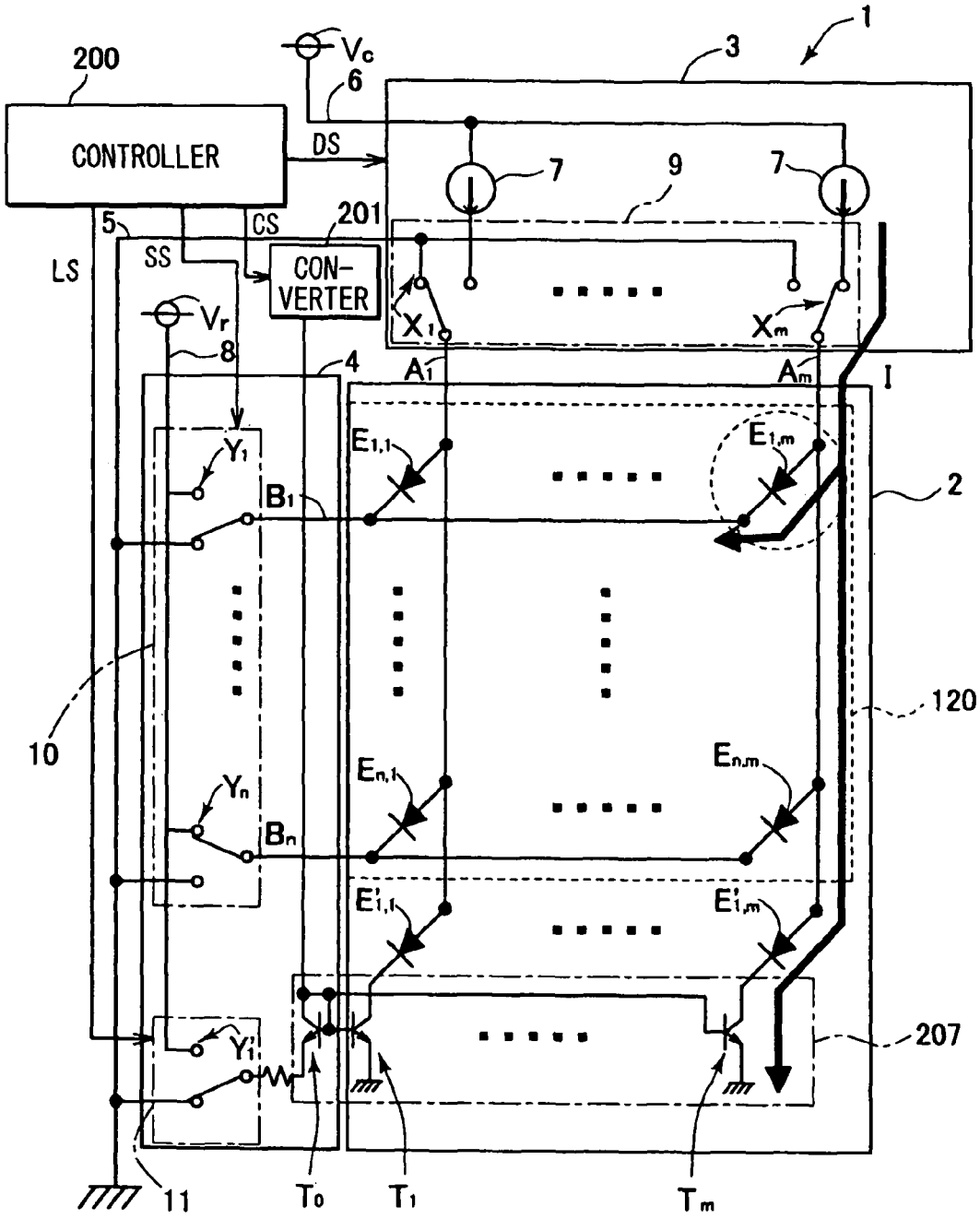
FIG. 11B is a circuit diagram showing a passive matrix type display device according to a fourth embodiment.

On the other hand, a configuration in FIG. 11B is an example of a circuit arrangement in which constant light adjustment currents can be conducted to corresponding light adjustment elements E' in accordance with an instructive current level, without counting the number of light emitting elements E of lit-up states leading to a selected scanning electrode B. More specifically, in the example, a current control circuit 207 is configured of a current mirror circuit including an input side transistor $T_0$ which receives a control voltage input CS for instructing a light adjustment level and which causes a control current corresponding to the control voltage to flow, and output side transistors $T_1$ to $T_m$ which are disposed in one-to-one correspondence with the individual light adjustment elements E' on respective data electrodes A and are connected to the input side transistor $T_0$ by sharing bases and which causes light adjustment currents Id whose value corresponds uniquely to the control current, to individually flow to the light adjustment elements E'.

The control voltage input CS has a voltage level reflecting the instructive current level and is converted into a current signal through a voltage/current conversion circuit 201, whereby the currents of identical level flow to the respective output side transistors $T_1$ to $T_m$ owing to the current mirror circuit. When the control voltage input CS is altered in accordance with the light adjustment level, the currents to flow through the input side transistor $T_0$ and the respective output side transistors $T_1$ to $T_m$ are varied, and the light adjustment currents of desired level can be fed to the individual light adjustment elements E'. When the control voltage input CS is continuously changed, the light adjustment current level, in turn, the lit-up intensity of the light emitting elements E can be continuously changed. Incidentally, when the control voltage input CS is made zero, the light adjustment current can be made substantially zero. In this case, therefore, a light adjusting switch Y' (switch circuit 11) can be omitted.

Figure 12:
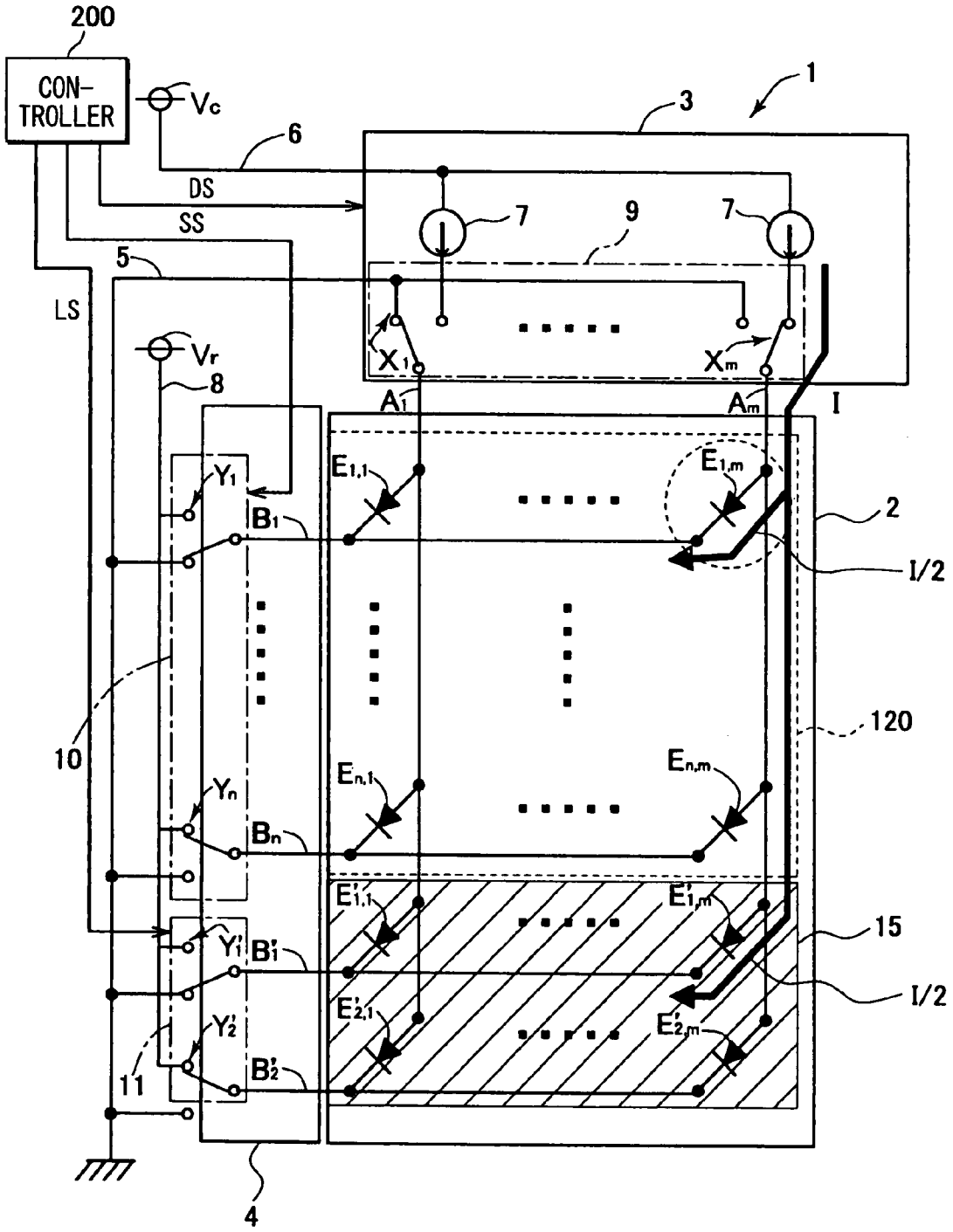
FIG. 12 is a circuit diagram showing a passive matrix type display device according to a fifth embodiment.

Incidentally, as shown in FIG. 12, each light adjustment element E' may well be configured of an element which emits light by the conduction of a light adjustment current Id. Especially, in a case where the light adjustment element E' is configured as the same element as a light emitting element E (that is, an element to which a stacked structure is common), the patterning etc. of the layers of parts corresponding to the light adjustment elements E' are not required at all, and a manufacturing process can be sharply simplified. Moreover, since the current conduction characteristics of the light adjustment elements E' can be brought into agreement with those of the light emitting elements E, light adjustment control specifications can be simplified. In this case, however, the light adjustment element E' emits light at the same intensity as that of the light emitting element E, and it is therefore necessary to dispose a shield portion 15 which hinders a light emission flux from the light adjustment element E' from leaking out in the viewing direction of a display area 120. The shield portion 15 can be formed in any of various aspects, for example, it is formed as part of a light-intercepting housing, or it is configured of a light-intercepting film or coating film.

Next, in case of adjusting light, a light adjustment electrode B' through which a light adjustment current is caused to flow may well be brought into a current conduction state continuously over a plurality of frames, or it can be brought into a cutoff state in a non-display period (also in this case, it is brought into the current conduction state continuously within individual frame periods). On the other hand, the light adjustment electrode B' can also be brought into the current conduction states intermittently in synchronism with the selection periods of individual scanning electrodes B, and this operating aspect is sometimes effective for, for example, the enhancement of the lifetime of the light adjustment elements E'. Besides, as shown at (1) to (5) in FIG. 14, the light adjustment electrode B' can be brought into the current conduction state with at least one scanning line jumped. That is, only in the selection periods of at least one scanning electrode B within one frame, the light adjustment electrode B' is brought into the current conduction state in synchronism with the selection period. Thus, the scanning lines composed of pixel strings can be decreased, for example, every predetermined number of lines, and the mean brightness of one frame can be adjusted in accordance with the number of the scanning lines to-be-decreased. On the other hand, as shown at (6) in FIG. 14, it is possible to perform a PWM control which reduces the current conduction period of the scanning electrode B (that is, the light emission period of the corresponding light emitting element E) at a predetermined duty ratio $\eta$, whereby the individual scanning lines can be uniformly decreased.

While the invention has been described with reference to preferred embodiments thereof, it is to be understood that the invention is not limited to the preferred embodiments and constructions. The invention is intended to cover various modification and equivalent arrangements. In addition, while the various combinations and configurations, which are preferred, other combinations and configurations, including more, less or only a single element, are also within the spirit and scope of the invention.

What is claimed is:

1. A passive matrix type display device comprising:

a display unit having a display area, wherein the display area has first and second directions, which intersect with each other;

a plurality of first electrodes disposed on the display area, wherein the plurality of first electrodes is arranged along with the second direction at predetermined first intervals, wherein each first electrode is capable of switching between a conductive state and a non-conductive state, wherein the first electrode in the conductive state is capable of passing a driving current so that the conductive state provides a light-emitting connection, and wherein the first electrode in the non-conductive state is capable of intercepting the driving current so that the non-conductive state provides a non-light-emitting connection;

a plurality of second electrodes disposed on the display area, wherein the plurality of second electrodes is arranged along with the first direction at predetermined second intervals;

a driving current source for controlling the driving current in a predetermined range and supplying the driving current to the plurality of second electrodes, wherein the driving current source is coupled with the plurality of second electrodes in a switchable manner between the conductive state and the non-conductive state;

a plurality of light-emitting elements disposed on the display area, wherein each light-emitting element is disposed at an intersection between the first electrode and the second electrode so that the light-emitting element provides a pixel;

a first circuit for selecting a part of the plurality of first electrodes, for controlling the part of the plurality of first electrodes to be in the conductive state, and for changing the part of the plurality of first electrodes sequentially so that the first circuit scans the plurality of first electrodes in a predetermined scanning period;

a second circuit for deciding a part of the plurality of second electrodes with respect to the scanning period, the part of the plurality of second electrodes corresponding to a part of the plurality of light-emitting elements for emitting a light, and for connecting the part of the plurality of second electrodes to the driving current source with respect to the scanning period;

a plurality of light-emission adjustment elements disposed on a part of the display unit other than the display area, wherein each adjustment element is coupled with the second electrode to be in parallel with the light-emitting element so that a part of the driving current passing through the second electrode branches from the other part of the driving current to be supplied to the light-emitting element, and wherein the part of the driving current provides an adjustment current; and a light-emission adjustment controller for controlling the light to be emitted from each light-emitting element in such a manner that the light-emission adjustment controller controls the adjustment current passing through each light-emission adjustment element so that the other part of the driving current to be supplied to the light-emitting element is adjusted.

2. The device according to claim 1, wherein each first electrode provides a scanning electrode, each second electrode provides a data electrode, the first circuit provides a scan driving circuit, and the second circuit provides a data driving circuit.

3. The device according to claim 1, wherein each light-emission adjustment element has a light-emitting brightness, which is smaller than a light-emitting brightness of the light-emitting element under a same voltage operation, or each light-emission adjustment element is a non-light emitting device.

4. The device according to claim 1, further comprising:

a shield, wherein each light-emission adjustment element is a light-emitting device for emitting the light by energizing with the adjustment current, and the shield prevents the light emitted from the light-emission adjustment element from leaking into the display area toward a visible direction.

5. The device according to claim 1, further comprising:

each light-emitting element is an organic electroluminescence device.

6. The device according to claim 5, further comprising:
the display unit includes a plurality of layers, which provides an organic multi-layered construction,
the organic multi-layered construction is disposed on the display area,
each organic electroluminescence element is integrated in the organic multi-layered construction so that the organic multi-layered construction provides the organic electroluminescence element,
the plurality of first electrodes is disposed on one side of the organic multi-layered construction,
the plurality of second electrodes is disposed on another one side of the organic multi-layered construction, and
each light-emission adjustment element is provided by at least a part of the organic multi-layered construction.

7. The device according to claim 6, wherein
each light-emission adjustment element has a light-emitting brightness, which is smaller than a light-emitting brightness of the light-emitting element under a same voltage operation, or each light-emission adjustment element is a non-light emitting device, and
the light-emission adjustment element is provided by removing at least a part of the organic multi-layered construction or by replacing at least a part of the organic multi-layered construction with another material layer.

8. The device according to claim 7, wherein
the organic multi-layered construction in the light emitting element includes an electron transportable material layer, a light emitting layer and a hole transportable material layer, which are stacked in this order,
each light-emitting element further includes a cathode and an anode, which sandwich the organic multi-layered construction,
the cathode is disposed on the electron transportable material layer, and the anode is disposed on the hole transportable material layer,
the cathode is provided by one of the first and second electrodes, and the anode is provided by the other one of the first and second electrodes, and
the light-emission adjustment element is provided by removing at least the light emitting layer from the organic multi-layered construction or by replacing at least the light emitting layer of the organic multi-layered construction with another material layer.

9. The device according to claim 8, wherein
the electron transportable material layer in the light emitting element includes an electron transport layer and an electron injection layer,
the electron transport layer contacts the light emitting layer, and the electron injection layer contacts the cathode,
the electron injection layer has a first electron affinity, the electron transport layer has a second electron affinity, and the cathode has a first work function,
a difference between the first work function and the first electron affinity is smaller than a difference between the first work function and the second electron affinity, and
the light-emission adjustment element is provided by removing at least the light emitting layer and the electron transport layer from the organic multi-layered construction and by including the hole transportable material layer.

10. The device according to claim 9, wherein
the light-emission adjustment element is provided by further removing at least the electron injection layer from the organic multi-layered construction.

11. The device according to claim 9, wherein
the hole transportable material layer in the light emitting element includes a hole transport layer and a hole injection layer,
the hole transport layer contacts the light emitting layer, and the hole injection layer contacts the anode,
the hole injection layer has a first ionization potential, the hole transport layer has a second ionization potential, and the anode has a second work function,
a difference between the first ionization potential and the second work function is smaller than a difference between the second ionization potential and the second work function, and
the light-emission adjustment element includes at least one of the hole transport layer and the hole injection layer.

12. The device according to claim 10, wherein
the hole transportable material layer in the light-emission adjustment element is made of an organic material,
the organic material has an ionization potential and an electron affinity, the cathode has a first work function, and the anode has a second work function, and
a difference between the ionization potential and the second work function is smaller than a difference between the first work function and the electron affinity.

13. The device according to claim 11, wherein
the organic material is a triphenylamine compound.

14. The device according to claim 8, wherein
the light emitting layer in the light emitting element is made of a host material having a dopant as an additive, the dopant being capable of improving a fluorescent quantum yield, and
the another material layer in the light-emission adjustment element has a dopant additive amount, which is smaller than a dopant additive amount of the light emitting layer in the light emitting element.

15. The device according to claim 14, wherein
the another material layer in the light-emission adjustment element is made of a mixture of an electron transportable organic material and a hole transportable organic material.

16. The device according to claim 15, wherein
the electron transportable material layer in the light emitting element includes an electron transport layer and an electron injection layer,
the electron transport layer contacts the light emitting layer, and the electron injection layer contacts the cathode,
the electron injection layer has a first electron affinity, the electron transport layer has a second electron affinity, and the cathode has a first work function,
a difference between the first work function and the first electron affinity is smaller than a difference between the first work function and the second electron affinity,
the hole transportable material layer in the light emitting element includes a hole transport layer and a hole injection layer,
the hole transport layer contacts the light emitting layer, and the hole injection layer contacts the anode,
the hole injection layer has a first ionization potential, the hole transport layer has a second ionization potential, and the anode has a second work function,
a difference between the first ionization potential and the second work function is smaller than a difference between the second ionization potential and the second work function, and
the another material layer in the light-emission adjustment element is made of a mixture of an electron transportable organic material providing the electron transportable material layer and a hole transportable organic material providing the hole transportable material layer.

17. The device according to claim 16, wherein the light-emission adjustment element includes the hole transport layer and the hole injection layer, which are disposed between the another material layer and the anode, and the light-emission adjustment element further includes the electron transport layer and the electron injection layer, which are disposed between the another material layer and the cathode.

18. The device according to claim 17, wherein the light-emission adjustment element further includes a second electron transport layer made of only an electron transportable organic material providing the light emitting layer, and in the light-emission adjustment element, the cathode, the hole injection layer, the hole transport layer, the another material layer, the second electron transport layer, the electron transport layer, the electron injection layer and the cathode are arranged in this order.

19. The device according to claim 1, wherein the driving current source includes a plurality of constant current circuits, each of which corresponds to the second electrode.

20. The device according to claim 1, further comprising:

a light-adjusting electrode, which is adjacent to the plurality of first electrodes, wherein each light-emission adjustment element is disposed at an intersection between the light-adjusting electrode and the second electrode, the plurality of light-emission adjustment elements is connected in parallel to each other, and the light-emission adjustment controller controls the adjustment current in each light-emission adjustment element through the light-adjusting electrode.

21. The device according to claim 20, wherein each light-adjusting electrode is capable of switching between the conductive state and the non-conductive state, the light-adjusting electrode in the conductive state is capable of passing the adjustment current therethrough, the light-adjusting electrode in the non-conductive state is capable of intercepting the driving current therethrough, and the light-emission adjustment controller switches the light-adjusting electrode between the conductive state and the non-conductive state.

22. The device according to claim 21, wherein the light-emission adjustment controller holds the light-adjusting electrode in the conductive state or the non-conductive state according to the light to be emitted from each light-emitting element during a predetermined time in the scanning period when the first circuit scans the plurality of first electrodes.

23. The device according to claim 21, wherein each light-emission adjustment element includes a plurality of light-emission adjustment devices, the light-adjusting electrode includes a plurality of light-adjusting terminals, each of which corresponds to the light-emission adjustment device, the light-emission adjustment controller has a plurality of light-emission adjustment patterns defining at least a part of the light-emission adjustment devices in such a manner that the adjustment currents passing through the plurality of second electrodes are different from each other, the light-emission adjustment controller selects one of the plurality of light-emission adjustment patterns based on the light to be emitted from each light-emitting element, the one of the plurality of light-emission adjustment patterns defines the part of the light-emission adjustment devices, and the light-emission adjustment controller collectively switches the part of the light-emission adjustment devices to the conductive state.

24. The device according to claim 23, wherein each light-emission adjustment pattern defines the number of light-emission adjustment devices, which provides the part of the light-emission adjustment devices, and the numbers of light-emission adjustment devices in the light-emission adjustment patterns are difference from each other.

25. The device according to claim 24, wherein each light-emission adjustment device has a same voltage-current characteristic, and as the light to be emitted from each light-emitting element becomes smaller, the number of the light-emission adjustment devices in the light-emission adjustment pattern, which is selected by the light-emission adjustment controller, becomes larger.

26. The device according to claim 23, wherein the light-emission adjustment devices connecting to the light-adjusting terminals have a same voltage-current density characteristic, and includes a part of the light-emission adjustment devices, each of which has a current conducting sectional area, the current conducting sectional area of the part of the light-emission adjustment devices is larger than a current conducting sectional area of the other part of the light-emission adjustment devices, and as the light to be emitted from each light-emitting element becomes smaller, the current conducting sectional area of the part of the light-emission adjustment devices in the light-emission adjustment pattern, which is selected by the light-emission adjustment controller, becomes larger.

27. The device according to claim 20, wherein the light-emission adjustment controller includes a current control circuit for variably controlling the adjustment current passing through the light-adjusting electrode in accordance with the number of the part of the second electrodes connecting to the driving current source.

28. The device according to claim 20, wherein the light-emission adjustment controller includes a current control circuit for variably controlling the adjustment current passing through each light-emission adjustment element with the second electrode in accordance with the light to be emitted from the light-emitting element.

* * * * *